US005150693A

United States Patent [19]

Ohnaka et al.

[11] Patent Number: 5,150,693

[45] Date of Patent: Sep. 29, 1992

[54] BOOST PRESSURE CONTROL SYSTEM FOR A SUPERCHARGED ENGINE

[75] Inventors: Hidemi Ohnaka; Masaaki Tanaka; Yuuichi Kato; Michio Furuhashi; Koichi Satoya; Yasuhiro Ooi, all of Susono, Japan

[73] Assignee: Toyota Jidosha Kabushiki Kaisha, Tokyo, Japan

[21] Appl. No.: 734,765

[22] Filed: Jul. 23, 1991

[30] Foreign Application Priority Data

Sep. 29, 1990 [JP] Japan ..... 2-262648

[51] Int. Cl.[5] ..... F02B 33/00

[52] U.S. Cl. ..... 123/559.3; 123/564

[58] Field of Search ..... 123/559.3, 564

[56] References Cited

U.S. PATENT DOCUMENTS 4,611,568 9/1986 Onaka et al. ..... 123/559.3
4,656,992 4/1987 Oonaka et al. ..... 123/559.3

FOREIGN PATENT DOCUMENTS 56-167817 12/1981 Japan .
59-5831 1/1984 Japan .
25917 2/1986 Japan ..... 123/564
61-14591 5/1986 Japan .
291723 12/1986 Japan ..... 123/559.3
7930 1/1987 Japan ..... 123/559.3
62-7932 1/1987 Japan .
271934 11/1987 Japan ..... 123/559.3
62-276220 12/1987 Japan .
38614 2/1988 Japan ..... 123/564

*Primary Examiner*—Michael Koczo
*Attorney, Agent, or Firm*—Oliff & Berridge

[57] ABSTRACT

A boost pressure control system for an engine, by which the degree of opening of the air bypass valve is adjusted and on/off of a mechanical supercharger operation is controlled to obtain an appropriate boost pressure. In the system, the degree of opening of the air bypass valve is adjusted in accordance with the load of the engine, based on different characteristics selected in accordance with whether the operation of the supercharger is started or stopped. If the engine is operated in a non-boost region, when the supercharger is operating the degree of opening of the air bypass valve is made larger to reduce the compression work of the supercharger, and when the operation of the supercharger is stopped, the degree of opening of the air bypass valve is made smaller to ensure that the air flow through the supercharger maintains the rotation of the rotors of the supercharger.

8 Claims, 5 Drawing Sheets

BOOST PRESSURE CONTROL SYSTEM FOR A SUPERCHARGED ENGINE

BACKGROUND OF THE INVENTION

1. Field of the Invention

The present invention relates to a boost pressure control system for an engine having a supercharger and an air bypass valve.

2. Description of the Related Art

A boost pressure control system utilizing an air bypass valve is commonly used for an engine supercharged by a mechanical supercharger (i.e., a supercharger driven by a crankshaft of the engine).

This type of pressure control system usually comprises an air bypass passage connecting the inlet and discharge sides of the supercharger, and an air bypass valve installed in the air bypass passage.

The boost pressure of the engine is controlled by adjusting the degree of opening of the air bypass valve in accordance with an engine load.

Namely, when the engine load is lower, the degree of opening of the air bypass valve is increased so that the amount of air recirculated from the discharge side of the supercharger to the inlet side thereof through the air bypass valve is increased, and by increasing the recirculated air flow, the pressure difference between the inlet and discharge sides of the supercharger, and thus the boost pressure, is reduced. Conversely, when the engine load is higher, the degree of opening of the air bypass valve is decreased to increase the boost pressure.

This type of boost pressure control system is disclosed, for example, by Japanese Unexamined Patent Publication No. 62-276220.

In this control system, the degree of the openings of a throttle valve disposed downstream of the supercharger, as well as an air bypass valve, are adjusted according to the depression of the accelerator pedal (i.e., the load of the engine). Namely, when the engine is operated at a low load in which the supercharger is not operated, the air bypass valve is locked in the fully open position and the inlet air flow to the engine is controlled by the throttle valve alone. Conversely, when the engine is operated at a high load in which the supercharger is operated, the throttle valve is kept fully open and a boost pressure and inlet air flow are controlled by the air bypass valve alone. Further, the degree of opening of the air bypass valve is changed according to a speed of the engine, to ensure that the changeover of the inlet air control from the throttle valve to the air bypass valve is smooth.

A boost pressure control system of a similar type is also disclosed in Japanese Examined Utility Model Publication No. 61-14591. In this system, the degree of opening of the air bypass valve is adjusted in accordance with a pressure in an inlet air manifold of the engine (i.e., a load of the engine), such that the degree of opening of the air bypass valve is increased as the engine load is reduced.

When the load of the engine is reduced, the air bypass valve is fully opened at the same time as the supercharger is stopped.

As disclosed in the prior art, the mechanical supercharger is usually driven by the engine crankshaft via a magnetic clutch, whereby the supercharger is operated or not operated during the operation of the engine.

For example, when the engine is operated at a high load in which a supercharging is required, the magnetic clutch is made "ON" (i.e., connected) to operate the supercharger, and when the engine load becomes lower than a predetermined value, the magnetic clutch is made "OFF" (i.e., disconnected) to stop the operation of the supercharger. Namely, disconnecting the supercharger when a supercharging is not required reduces a power loss incurred when the supercharger is being driven, and therefore, the fuel consumption by the engine is improved.

In the boost pressure control system having a mechanical supercharger with a magnetic clutch, preferably the speeds of the engine and the supercharger coincide as much as possible when the magnetic clutch is made ON.

This is because, if there is a large difference between these speeds, a large starting torque caused by an inertial mass of the charger rotors is exerted on the engine crankshaft at the moment the magnetic clutch is made ON, and this is a cause of an undesirable engine output torque shock.

In the boost pressure control system disclosed by the above 62-276220 Publication, the air bypass valve is sometimes kept fully open when the supercharger is not operated. In this condition, the rotation of the rotors of the supercharger is completely stopped, because all of the inlet air flows through the air bypass passage.

Consequently, when the magnetic clutch is made ON, a large difference exists between the engine speed and the supercharger rotor speed, and thus an unwanted torque shock occurs.

In the system disclosed by the 61-14591 Publication, it is possible to prevent this torque shock by controlling the air bypass valve such that the air bypass valve is not fully open when the magnetic clutch is made OFF. This can be accomplished by setting the air bypass valve to a not fully open state until the load becomes much lower than the load at which the magnetic clutch is made ON or OFF.

By keeping the air bypass valve partially closed, the flow resistance in the air bypass passage is kept higher and a part of the inlet air flows through the supercharger. This air flow rotates the rotors of the supercharger, and therefore, the difference in the speeds of the engine and the rotors is kept low while the magnetic clutch is OFF, and thus the resultant torque shock when the clutch is made ON is reduced.

However, a problem arises if the air bypass valve is partially closed when the clutch is OFF in a system using a magnetic clutch, in that usually it is necessary to incorporate a time delay in the switching OFF action of the magnetic clutch. This time delay is necessary to avoid a frequent ON and OFF operation of clutch due to temporary changes of the engine load, because such a frequent ON and OFF operation of the clutch will lead to excessive wear and shorten the service life of the clutch.

By incorporating the time delay, the supercharger continues to operate for a predetermined time after the engine load is within a region in which a supercharging operation is not required. If the air bypass valve is not fully opened while the engine load is within this region, the supercharging operation is carried out while the air bypass valve is partially closed. This causes an unnecessary increase in the boost pressure in this region, and thus the fuel consumption of the engine is worsened due to an unnecessary compression operation by the supercharger.

To solve these problems, it is necessary to control the air bypass valve such that:

(1) When the engine is operated in the region in which supercharging is not required (hereinafter called "non-boost operation region"), the air bypass valve is partially closed after the magnetic clutch is made OFF, to maintain a rotation of the rotors of the supercharger by the air flow; and (2) When the engine load is in the non-boost region, the air bypass valve is fully opened to reduce the amount of compression required from the supercharger if the supercharger is operating.

Such a control, however, cannot be accomplished by the boost pressure control systems of the prior arts.

SUMMARY OF THE INVENTION

Therefore, an object of the present invention is to solve the aforementioned problems by providing a boost pressure control system by which shock is eliminated when the magnet clutch is made ON, without a worsening of the fuel consumption.

According to the present invention, there is provided a boost pressure control system for an engine, comprising: a supercharger installed at an inlet air passage of the engine and driven by a crankshaft of the engine through a clutch, an operation of said supercharger being started or stopped by connecting or disconnecting said clutch during the engine operation; an air bypass passage connected, at one end thereof, to an inlet air passage upstream of the supercharger, and at the other end thereof, to an inlet air passage downstream of the supercharger; an air bypass valve mounted in the air bypass passage for adjusting the amount of air flowing through the air bypass passage; and, a bypass control means for controlling said air bypass valve by adjusting a degree of opening of the air bypass valve to a value determined by a load of the engine, based on predetermined relationship, said bypass control means using different relationships in accordance with whether the supercharger is operating or not operating.

The present invention will be better understood from the description of a preferred embodiment thereof as set forth below, with reference to the accompanying drawings.

DESCRIPTION OF A PREFERRED EMBODIMENT

Figure 1:
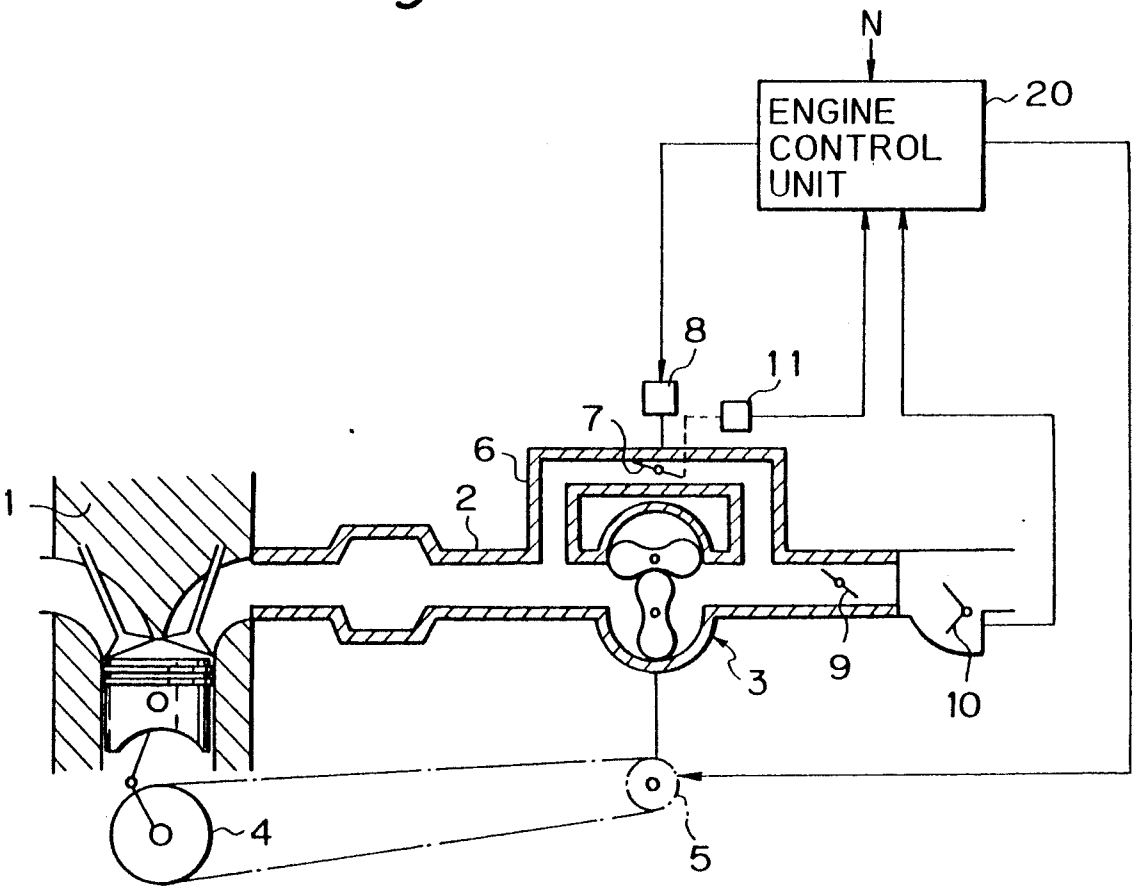
FIG. 1 is a schematic view of an engine fitted with a boost pressure control system.

FIG. 1 illustrates an embodiment of the boost pressure control system according to the present invention.

Referring to FIG. 1, reference numeral 1 represents an engine, 2 is a inlet air passage, and 3 represents a supercharger installed at the inlet air passage 2. In this embodiment, a Roots type blower is used as the supercharger 3. The supercharger 3 is driven by a crank pulley 4 attached to the crankshaft of the engine 1, via a drive belt and a magnetic clutch 5.

The operation of the clutch 5 can be started or stopped during the operation of the engine by connecting (ON) or disconnecting (OFF) the magnetic clutch 5.

Numeral 6 denotes an air bypass passage connecting portions of the inlet air passage 2 upstream and downstream of the supercharger 3, and an air bypass valve 7 is disposed in the air bypass passage 6. The air bypass valve 7 is driven by an actuator such as a stepping motor 8, and can be set to any position between fully closed and fully open. A throttle valve 9 and an air flow meter 10 are disposed at the inlet air passage 2, upstream of the supercharger 3.

Reference numeral 20 shows an engine control unit for performing fundamental controls of the engine, such as an ignition timing control or a fuel injection control. The engine control unit 20 is a known type of digital computer and further performs the control of the boost pressure control system of the present invention. To perform these controls, an inlet air flow signal and an engine speed signal are input to the control unit 20 from the air flow meter 10 and engine speed sensor (not shown) respectively. Also, a bypass valve opening angle sensor 11 inputs a signal representing a degree of opening of the air bypass valve 7, to the control circuit 20.

The output port of the control unit 20 is connected to the stepping motor 8 and the magnetic clutch 5 via a corresponding drive circuit (not shown), and the operation of the supercharger 3 and the position of the air bypass valve 7 are controlled by the control unit 20, by operating the magnetic clutch 5 and the stepping motor 8 respectively.

Figure 3:
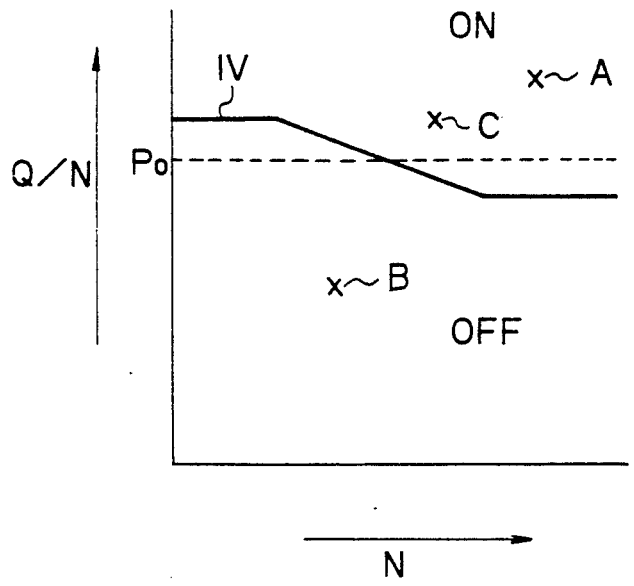
FIG. 3 illustrates the relationship between the engine load and the operation of the supercharger.

FIG. 3 illustrates the characteristics of the ON/OFF operation of the magnetic clutch 5.

In this embodiment, the ON/OFF operation of the magnetic clutch is controlled by an engine control unit 20 based on the curve IV in FIG. 3.

In the figure, the vertical axis represents a value Q/N, which is a value of an inlet air flow Q divided by an engine speed N, and is used as a parameter expressing a load of the engine. The horizontal axis represents an engine speed N.

As shown in the figure, the magnetic clutch 5 is made ON to start the operation of the supercharger when the load of the engine is high, and is made OFF when the load of the engine is low to stop the operation of the supercharger and save the power used by an unnecessary compression operation.

In this embodiment, the ON/OFF operation of the magnetic clutch 5 is initiated at a higher load when the engine speed is low and at a lower load when the engine speed is high, but the magnetic clutch 5 can be made ON and OFF at a constant load value throughout the whole speed range of the engine. Also, to avoid excessive wear, the magnetic clutch 5 may be maintained ON, regardless of the load, when the engine speed is high.

Figure 4:
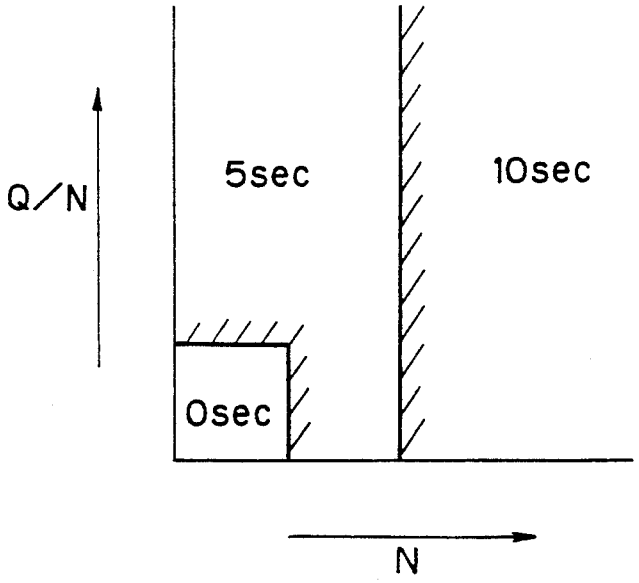
FIG. 4 illustrates the setting of an OFF delay time of the magnetic clutch; and, FIGS. 5A and 5B are a flow chart of a routine for controlling the air bypass valve.

FIG. 4 illustrates the setting of the time delay incorporated in the OFF operation of the magnetic clutch 5.

As explained before, to prevent a frequent ON and OFF operation of the magnetic clutch 5, and the resulting excessive wear thereof, it is preferable to delay the OFF operation of the magnetic clutch 5 for a predetermined time so that the magnetic clutch is not made OFF by short cycle load variations.

As shown in the figure, in this embodiment, the delay time is determined by a load and speed of the engine.

Namely, in the low speed and low load region, the delay time is set to zero, and in the high speed region, the time delay is set to, for example, 10 seconds, regardless of the engine load, and to 5 seconds in the remaining region.

Figure 2:
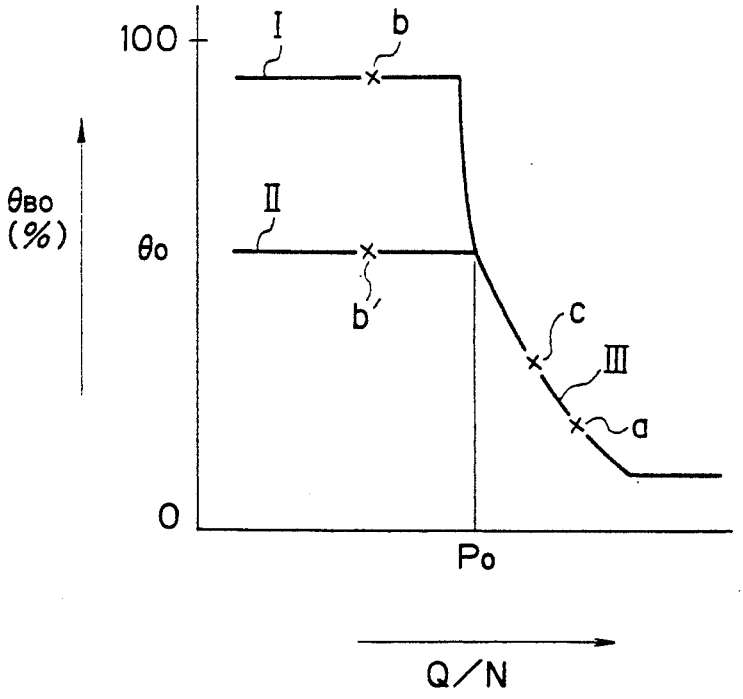
FIG. 2 illustrates the relationships between the engine load and the degree of opening of the air bypass valve.

FIG. 2 illustrates the control characteristics of the air bypass valve according to the present invention. Referring to the figure, the horizontal axis represents an engine load (Q/N), and the vertical axis represents a degree of opening of the air bypass valve ($\theta_{B0}$).

In this embodiment the air bypass valve 7 is controlled in accordance with the engine load, but when the engine load is lower than a predetermined value (i.e., $P_0$ in the figure), the air bypass valve is controlled by different control characteristics, depending on the ON or OFF state of the magnetic clutch 5.

The curve I in the figure represents the control characteristics of the air bypass valve 7 when the magnetic clutch 5 is ON. According to the curve I, the air bypass valve is set to be almost fully open (e.g., more than 90%) immediately after the engine load becomes lower than $P_0$, and is kept at the same fully open position in the lower load region.

The curve II in the figure represents the control characteristics when the magnetic clutch 5 is OFF. In this case, the air bypass valve is kept at a partially closed position (in this embodiment, the same position ($\theta_0$) as at a load $P_0$) which is a smaller degree of opening than that in the case of curve I.

When the engine load is higher than $P_0$, the air bypass valve 7 is controlled in accordance with the characteristic curve III, regardless of the ON and OFF state of the magnetic clutch 5.

The load $P_0$ is preferably set near to the load at which the ON and OFF operation of the magnetic clutch is initiated (for example, as shown in FIG. 3).

Assuming that the engine is operated at point A in FIG. 3, i.e., a relatively higher load in the region in which a supercharging operation is required (the region above line IV in FIG. 3, hereinafter called "boost operation region"), when the engine is operated at point A in FIG. 3, the air bypass valve is controlled in accordance with the characteristic curve III in FIG. 2, and is set to a point A between a fully closed position and a position $\theta_0$ ($\theta_0$ is the position of the air bypass valve when the engine load is $P_0$).

When the engine load drops from point A to point B in the non-boost operation region in FIG. 3, although a supercharging operation is not required in this region, the magnetic clutch 5 is not immediately made OFF because of the action of the delay timer. Accordingly, the supercharger 3 continues to operate for the time determined by FIG. 4.

In this case, the air bypass valve 7 is controlled by the characteristic curve I in FIG. 2, because the magnetic clutch 5 is still ON, and the air bypass valve 7 is immediately opened to almost a fully open position (point b in FIG. 2).

This allows the air discharged from the supercharger to be recirculated to the inlet of supercharger through the air bypass passage, and therefore the pressure of the air at the inlet and outlet of the supercharger becomes almost the same, and the compression obtained from the supercharger is reduced to almost zero.

Therefore, even if the supercharger is operating in the non-boost region, the power loss of the engine for driving the supercharger is minimized.

When the delay time has passed, the magnetic clutch is made OFF, and this causes the air bypass valve to be controlled by the characteristic curve II in FIG. 2. Then, the air bypass valve is closed to the position b' in FIG. 2, in which the degree of the opening of the valve is $\theta_0$.

Because the bypass valve 7 is partially closed in this condition, a part of the inlet air flows through the supercharger 3 and rotates the rotors thereof at a certain speed.

From this condition, if the engine load is increased to point C in the boost region (FIG. 3), the magnetic clutch is immediately made ON.

Nevertheless, as explained above, the rotors of the supercharger are rotating even when the magnet clutch is OFF, and therefore, the magnetic clutch can be connected without torque shock because the difference between the speeds of the engine and the supercharger rotors is small.

Also, because the air bypass valve is set at position c in FIG. 2 at almost the same time as that at which the supercharger is started, a suitable control of the boost pressure is obtained immediately after the start of the supercharger.

The degree of the opening of the air bypass valve $\theta_0$ must be small to maintain the rotation of the rotors of the supercharger at a sufficiently high speed when it is not operating, but $\theta_0$ must be large enough that an excessive increase of the pressure drop at the inlet air passage does not occur.

Also, if $\theta_0$ is too small, the increase of boost pressure is too high when the supercharger is started, and this may cause a sudden increase in engine torque under certain conditions. In this embodiment, $\theta_0$ is set to about 60%, to avoid these problems.

Figure 5A:
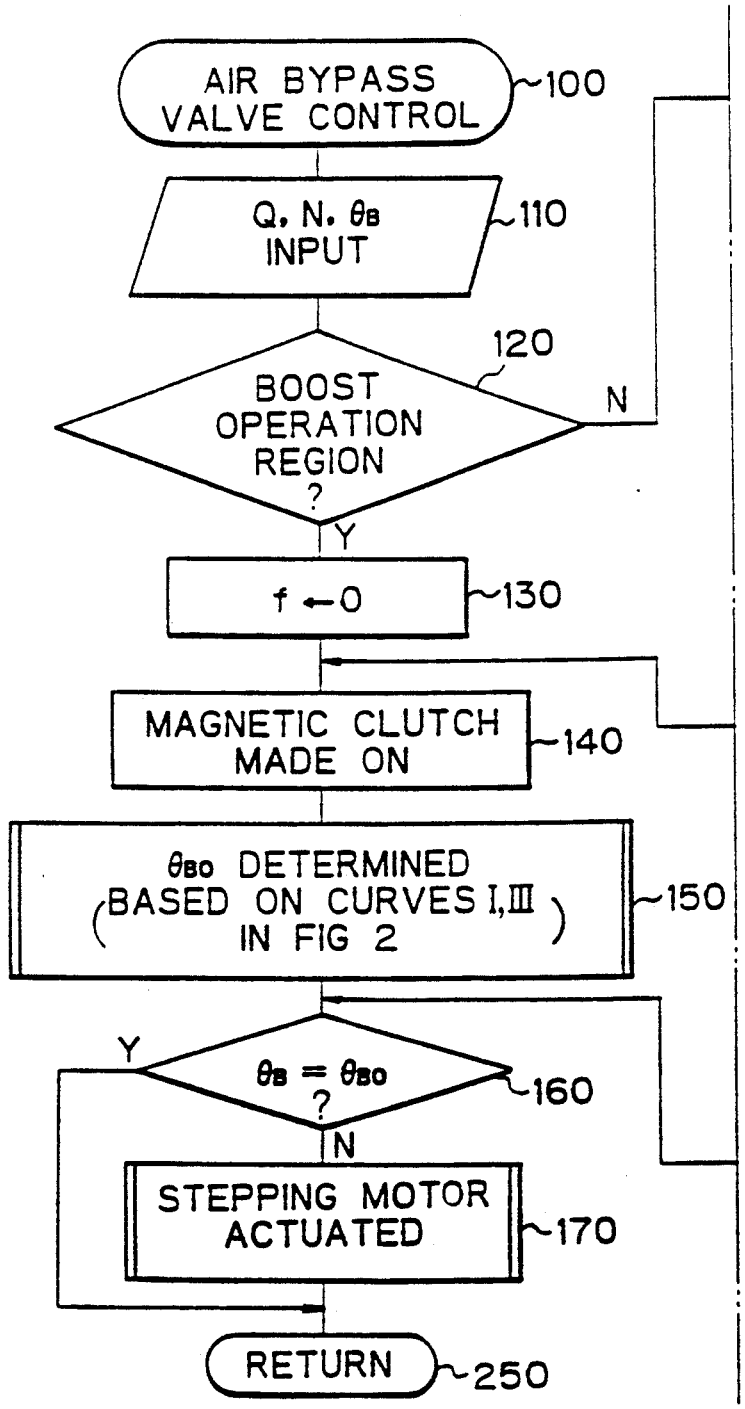
Figure 5B:
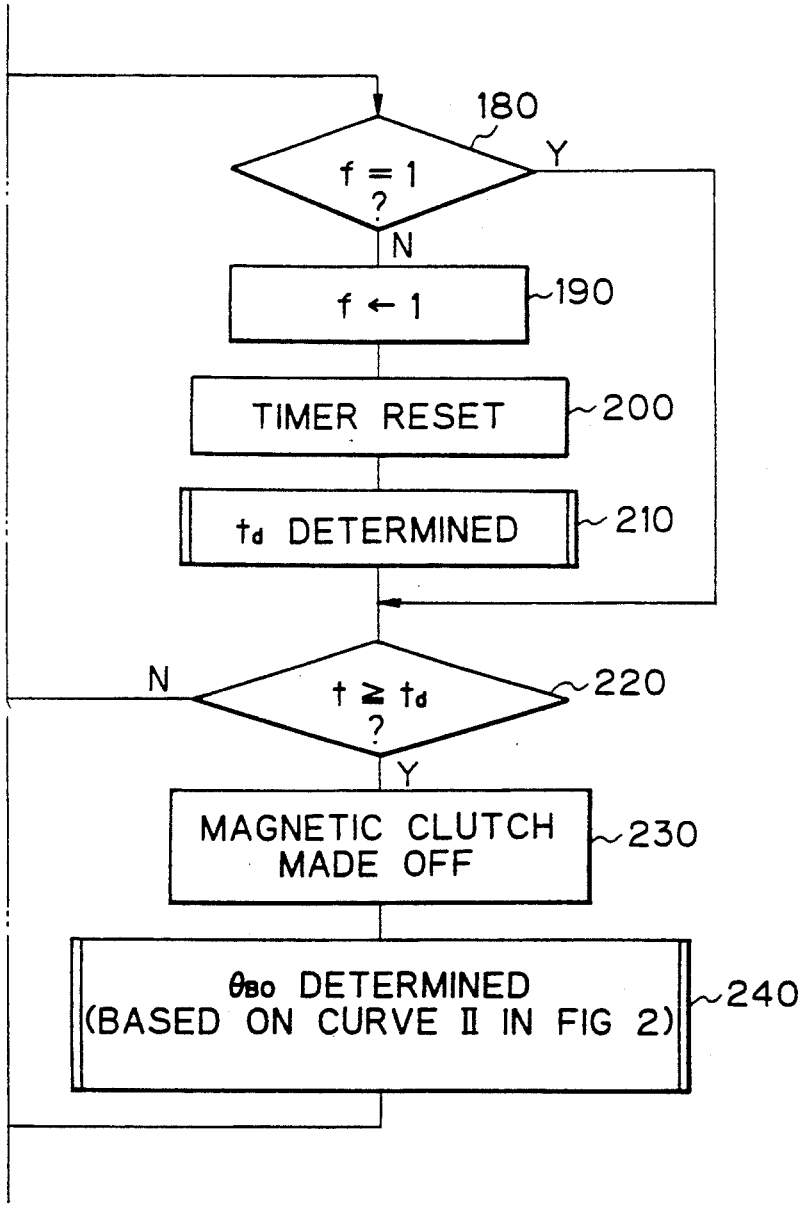

FIGS. 5A and 5B illustrate a routine for controlling the air bypass valve 7 and the magnetic clutch 5. This routine is processed by the engine control unit 20 by sequential interruptions at predetermined intervals (e.g., 8 mm sec).

Referring to FIG. 5A, in step 110 parameters such as an inlet air flow (Q), an engine speed (N), a degree of opening of the air bypass valve ($\theta_B$) are read from corresponding sensors, and then in step 120, it is determined whether the load condition of the engine is in the boost operation region (i.e., the region in which the supercharged operation of the engine is required). This is determined by an inlet air flow (Q) and engine speed (N) based on FIG. 3. If the load condition is in the boost operation region, the routine proceeds to step 130 in which a flag f is reset. The flag f is used for controlling a delay timer, as explained later.

Then, in step 140, the magnetic clutch is made ON to initiate the operation of the supercharger, and in step 150, the value $\theta_{B0}$ for setting the degree of opening of the air bypass valve is determined from the engine load (Q/N) and the characteristic curves I and III.

Then, in steps 160 and 170, the degree of opening of the air bypass valve is set at $\theta_{B0}$.

Namely, in step 160, it is determined whether the actual value $\theta_B$ of the degree of opening of the air bypass valve (read in step 110) is equal to the setting value $\theta_{B0}$. If $\theta_B$ is not equal to $\theta_{B0}$, in step 170 the stepping motor 8 of the air bypass valve is actuated by an amount determined by the difference between $\theta_B$ and $\theta_{B0}$.

The actuation of the stepping motor may be controlled such that the stepping motor is operated by a predetermined constant amount (in a forward or a reverse rotation) per one execution of the routine, or may be such that the stepping motor is operated by an amount determined by the amount of difference between $\theta_B$ and $\theta_{B0}$ per one execution of the routine.

By this operation, the opening of the air bypass valve is appropriately controlled in accordance with the load condition of the engine when the supercharger is operating.

If the load condition is not in the boost operation region in step 120, then the routine proceeds to step 180 and it is determined whether the flag f is set.

As explained above, the flag f is always reset in step 130, when the load condition is in the boost operation region. Therefore, if the flag f is not set in step 180, this means that this is the first execution of the routine after the operating condition of the engine has changed from the boost operation condition to the non-boost operation region.

If the flag is set in step 190, in step 200 a timer incorporated in the engine control unit 20 is started to count the delay time, and then in step 210, the delay time $t_d$ for the OFF operation of the magnetic clutch is set in accordance with an engine speed N and the relationship in FIG. 4.

If the flag was already set in step 180, this means that steps 190 to 210 have been already processed and the timer has already started to count the delay time, and thus the routine proceeds to step 220 without processing steps 190 to 210.

In step 220, it is determined whether the delay time $t_d$, set in step 210, has lapsed, and if the delay time $t_d$ has not lapsed, the routine proceeds to step 140 and the steps 140 to 170 are processed as explained above while the magnetic clutch is ON.

If the delay time $t_d$ has lapsed in step 220, the routine proceeds to step 230 and the magnetic clutch is made OFF. Then, in step 240, the setting valve $\theta_{B0}$ for the degree of opening of the air bypass valve is determined in a similar manner as in step 150, except that $\theta_{B0}$ is determined from Q/N and the characteristic curves II and III in step 240.

The routine then proceeds to step 160, and the degree of opening of the air bypass valve is set at $\theta_{B0}$ in steps 160 and 170 as explained before.

By this control, the air bypass valve is fully opened during a delay time $t_d$ for which the supercharger is running in the non-boost operation region (steps 220, 140, 150 and the characteristic curve I in FIG. 4), and partially closed after the magnetic clutch is made OFF (steps 220, 230, 240 and the characteristic curve II in FIG. 4).

According to the present invention, the air bypass valve is fully opened when the supercharger is operated in the non-boost region during this delay time, and therefore, the power loss for driving the supercharger is minimized and the fuel consumption of the engine is improved.

After the supercharger is stopped, since the air bypass valve is maintained in the partially closed condition, the rotors of the supercharger are rotated at a certain speed until the supercharger is re-started. Therefore, an unpleasant shock caused by the connecting of the magnetic clutch can be avoided.

We claim:

1. A boost pressure control system for an engine comprising:

a supercharger disposed at an inlet air passage of the engine and driven by said engine via a power transmission clutch, an operation of said supercharger being started or stopped by connecting or disconnecting said clutch;

an air bypass passage being connected, at one end thereof, to an inlet air passage upstream of the supercharger, and at the other end thereof, to an inlet air passage downstream of the supercharger;

an air bypass valve disposed in said air bypass passage and controlling an air flow through the air bypass passage in accordance with a degree of opening of the air bypass valve; and a bypass control means for controlling said air bypass valve by setting the degree of opening thereof to a value given as a function of an engine load, said function being selected by the bypass control means from among a plurality of predetermined functions in accordance with whether the operation of the supercharger is started or stopped.

2. A boost pressure control system according to claim 1, wherein a different function is selected as said function for determining the degree of opening of the air bypass valve in accordance with a start or stop of said operation of the supercharger only when the engine load is lower than a predetermined value.

3. A boost pressure control system according to claim 2, wherein said different function is selected so that the degree of opening of the air bypass valve is made larger when the supercharger is operating than when the supercharger is stopped.

4. A boost pressure control system according to claim 3, wherein the degree of opening of the air bypass valve is maintained at a constant value when the supercharger is stopped.

5. A boost pressure control system according to claim 1, wherein said supercharger is operated when a load of the engine is increased and becomes higher than a predetermined value, and is stopped when a load of the engine falls and a predetermined time has elapsed after the load of the engine becomes lower than said predetermined value.

6. A boost pressure control system according to claim 5, wherein a different function is selected as said function for determining the degree of opening of the air bypass valve in accordance with whether said supercharger is operating or not operating only when the engine load is lower than said predetermined value for the start and stop of the operation of the supercharger.

7. A boost pressure control system according to claim 6, wherein said different function is selected so that the degree of opening of the air bypass valve is made larger when the supercharger is operating than when the supercharger is stopped.

8. A boost pressure control system according to claim 7, wherein the degree of opening of the air bypass valve is maintained at a constant value when the supercharger is stopped.

* * * * *